US008240199B2

(12) United States Patent
McMiles

(10) Patent No.: US 8,240,199 B2
(45) Date of Patent: Aug. 14, 2012

(54) HYDRAULIC SIGNATURE TESTER

(76) Inventor: Barry James McMiles, Katy, TX (US)

( * ) Notice: Subject to any disclaimer, the term of this patent is extended or adjusted under 35 U.S.C. 154(b) by 221 days.

(21) Appl. No.: 12/674,440

(22) PCT Filed: Dec. 15, 2009

(86) PCT No.: PCT/US2009/068063
§ 371 (c)(1),
(2), (4) Date: Feb. 22, 2010

(87) PCT Pub. No.: WO2010/077868
PCT Pub. Date: Jul. 8, 2010

(65) Prior Publication Data
US 2011/0259095 A1 Oct. 27, 2011

(51) Int. Cl.
*E21B 47/00* (2012.01)

(52) U.S. Cl. ..... 73/152.53

(58) Field of Classification Search ... 73/152.51–152.53
See application file for complete search history.

(56) References Cited

U.S. PATENT DOCUMENTS

| | | | | |
|---|---|---|---|---|
| 3,270,557 | A * | 9/1966 | McClocklin | 73/168 |
| 5,381,136 | A * | 1/1995 | Powers et al. | 340/539.26 |
| 5,908,990 | A * | 6/1999 | Cummings | 73/861.22 |
| 5,979,704 | A * | 11/1999 | Holmes et al. | 222/63 |
| 6,654,697 | B1 * | 11/2003 | Eryurek et al. | 702/47 |
| 6,957,577 | B1 * | 10/2005 | Firmin | 73/152.51 |
| 7,503,340 | B2 * | 3/2009 | Klee et al. | 137/487.5 |
| 2004/0238178 | A1 * | 12/2004 | Laureano et al. | 166/368 |
| 2005/0173112 | A1 * | 8/2005 | Kavaklioglu et al. | 166/250.01 |
| 2008/0185143 | A1 * | 8/2008 | Winters et al. | 166/250.07 |

* cited by examiner

*Primary Examiner* — John Fitzgerald

(57) ABSTRACT

The present invention provides a subsea apparatus for testing a hydraulic signature which has a fluid supply, a first pressure line coupled to the fluid supply, a second pressure line coupled to the fluid supply; and a pressure recording device operatively coupled to both the first pressure line and the second pressure line. A pressure recording device is capable of storing pre-determined pressure data representative of said pressure lines. The first pressure line functions at a lower pressure than the second pressure line while a pressure recording device records data to allow comparison of actual pressure data on the first and second pressure lines with said stored data.

13 Claims, 1 Drawing Sheet

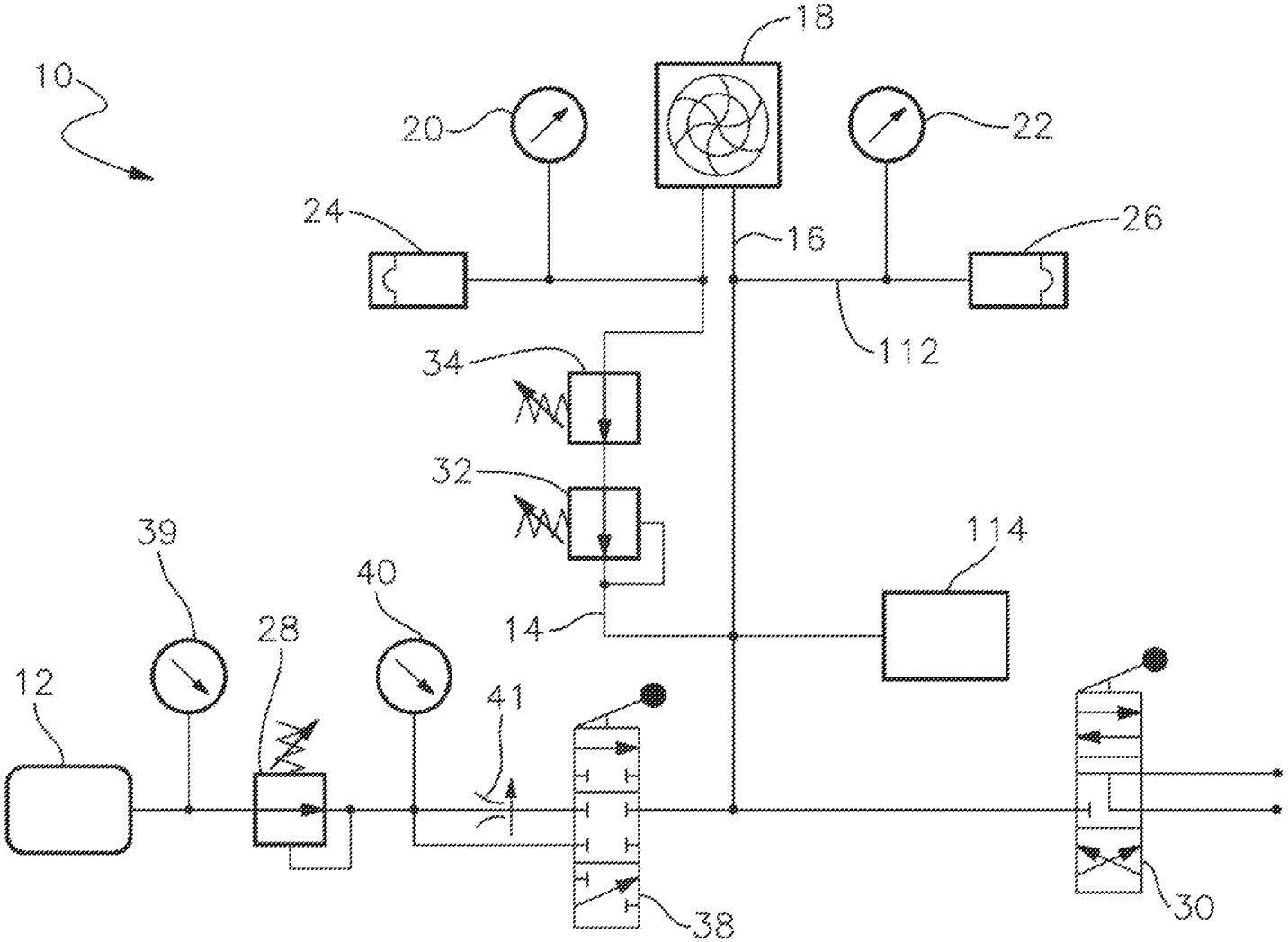
10
12
39
28
40
41
24
20
34
32
14
18
16
112
22
26
114
30
38

HYDRAULIC SIGNATURE TESTER

FIELD OF INVENTION

The present invention relates in general to the field of subsea equipment.

BACKGROUND ART

The present invention relates to methods and systems for subsea energy extraction. In particular, the present invention relates to a hydraulic signature tester for assessment and monitoring of pressure systems.

Various mechanisms have been employed to prevent failure of subsea components due in part to maintenance being performed normally on a time related basis rather than a condition based scenario. This not only adds needless costs, it also opens the system up for infant mortality of critical equipment due to needless repairs.

Thus there exists a need for an apparatus that is capable of dynamically measuring fluid flow anomalies via pressure and time constraints during normal maintenance checks to fully analyze the condition of the equipment to determine if a repair is required. After repairs, the system of a preferred embodiment of the invention is used not only to confirm the quality of the repair, but also provide a new birth certificate for the repaired equipment to be used as a base line for future tests. In the case of new equipment, analysis with this system would be the initial birth certificate.

SUMMARY OF THE INVENTION

The present invention provides a subsea apparatus for monitoring and testing of a hydraulic signature having a fluid supply, a first pressure line coupled to the fluid supply, a second pressure line coupled to the fluid supply; and a pressure recording device operatively coupled to both the first pressure line and the second pressure line. Storage of predetermined pressure data is representative of the aforementioned pressure lines. The first pressure line can function at a lower pressure than the second pressure line. A pressure recording device records data to allow comparison of actual pressure data on said lines with said stored data.

BRIEF DESCRIPTION OF THE DRAWINGS

Further benefits and advantages of the present invention will become more apparent from the following description of various embodiments that are given by way of example with reference to the accompanying drawings:

FIG. 1 represents a schematic view of a hydraulic signature tester according to a preferred embodiment of the invention.

DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Referring now to the figure, FIG. 1 illustrates a schematic view of an apparatus for testing a hydraulic signature 10. Apparatus for testing a hydraulic signature 10 includes fluid supply 12, first pressure line 14, second pressure line 16, and pressure recording device 18. Pressure recording device 18 couples to first pressure line 14 and second pressure line 16. First pressure line 14 functions at a lower pressure than second pressure line 16. Pressure recording device 18 records data to allow interpretation of both real time and theoretical pressure rates. As pressurized fluid is conveyed from a source such as fluid supply 12, after passing through optional valves, it is dispensed into first pressure line 14 and second pressure line 16. First pressure line 14 is intended to withstand lower pressures. Second pressure line 16 is intended to withstand higher pressures.

First pressure line 14 ultimately conveys lower pressure readings into pressure recording device 18. Second pressure line 16 also ultimately conveys a pressure reading into pressure recording device 18. Pressure recording device 18 receives pressure inputs from first pressure line 14 and second pressure line 16 and compares pressure values received to theoretical pressure values developed through lab testing in various conditions, or through calculation. As pressure recording device 18 monitors real time pressures, it compares them to numerous inputs. Pressure recording device 18 can also monitor real time pressures when coupled to other systems, such as a blow out "BOP" preventer. After pressure recording device 18 has received pressure values, pressure may be relieved from first pressure line 14 and second pressure line 16. First pressure line 14 may release pressure via relief valve 24. Second pressure line 16 may release pressure via relief valve 26. A first pressure gauge 20 operatively couples to first pressure line 14 to provide real time pressure, second pressure gauge 22 operatively couples to second pressure line 16 to provide real time pressure.

In certain embodiments pressure gauge 20 may operatively associate with first pressure line 14. Additionally, pressure gauge 22 may operatively associate with second pressure line 16. First pressure line 14 may also include a relief mechanism 24 for releasing pressure from first pressure line 14. Second pressure line 16 may also include a relief mechanism 26 for releasing pressure from second pressure line 16.

Regulating mechanism 28 may be operatively disposed between fluid supply 12 and first pressure line 14. Similarly, regulating mechanism 28 may be operatively disposed between fluid supply 12 and second pressure line 16. Transducer 30, or similar communicating device, may operatively couple to first pressure line 14, second pressure line 16, or both lines to transmit pressure readings to an offsite source.

First pressure line 14 may optionally include gauge saving valve 32 in order to control fluid flow. Additionally isolation valve 34 may be included to fully prevent fluid flow from reaching pressure recording device 18 in certain instances. Such instances arise when greater pressures are being transmitted to pressure recording device 18 via second pressure line 16. In certain embodiments, an apparatus may be coupled to fluid supply 12 that maintains a constant fluid flow regardless of pressure and temperature variations.

Additionally, numerous hydraulic valves may be installed about various portions of apparatus for testing a hydraulic signature 10. For example, hydraulic valve 38 may be oriented to prevent pressure from over accumulating in first pressure line 14 and second pressure line 16. Disposing hydraulic valve 38 in a position that allows pressure to enter first pressure line 14 and second pressure line 16 without overly accumulating, and allows for apparatus for testing a hydraulic signature 10 to be oriented in a steady state condition so that fluid entering from fluid supply 12 is constant throughout the system. In the event of an emergency, fluid contained within apparatus for testing a hydraulic signature 10 may be immediately released by opening hydraulic valve 30.

Similarly, valve 38 may be disposed prior in sequence for first pressure line 14 and second pressure line 16 to prevent fluid from entering first pressure line 14 and second pressure line 16. In the event that bursts of high pressure or low pressure fluids are required to be implemented towards pressure recording device 18, pressure may build after entering through fluid supply 12 and be subsequently released through valve 38. An initial pressure gauge 39 may be disposed prior to regulating mechanism 28 in order to measure fluid pressure emanating from fluid supply 12. Pressure gauge 40 may be disposed prior to entering valve 38 in order to measure pressure within the fluid line, to measure pressure exerted on hydraulic valve 38, to determine pressure drop over first pressure line 14 and 15 , second pressure line 16, and to compare real time pressure exertion of other pressure gauges. Additionally, a pressure reducing mechanism 41 may be disposed between regulating mechanism 28 and hydraulic valve 38.

In operation, fluid may accumulate within one or more fluid lines while leaving hydraulic valve 38 closed. After sufficient fluid has accumulated within one or more fluid lines and pressure has reached steady state, a reading may be taken from pressure gauge 40. After a reading has been taken and assuming hydraulic valve 30 is in a closed position, valve 38 may be opened in order to allow fluid to reach first pressure line 14 and second pressure line 16. As pressure is released into first pressure line 14 and second pressure line 16, and assuming relief valve 24 and relief valve 26 are in closed positions, pressure recording device 18 may take real time pressure values. At the same time, pressure values are being recorded, in readings taken from first pressure gauge 20, second pressure gauge 22, and readings taken pressure gauge 40, may all be compared to ensure that first pressure line 14 and second pressure line 16 are maintaining pressure. It is plausible that a small drop may be noted, but the drop should be minimal. Once pressure recording device 18 has performed its function, pressurized fluid held within first pressure line 14 and second pressure line 16 may be released via relief valve 24 and relief valve 26.

Regulating mechanism 28 may be implemented ahead of pressure gauge 40 in order to control the amount of fluid entering apparatus for testing a hydraulic signature 10. Regulating mechanism 28 may be implemented in order to establish a laminar or steady state fluid flow entering apparatus 10. Similarly regulating mechanism 28 may be implemented to control fluid input into apparatus for testing hydraulic signature 10.

In certain embodiments, pressure recording device 18 can be used to illustrate flow rate and pressure trends. For example, apparatus for testing hydraulic signature 10 can be initially employed to receive initial pressure values. Pressure values which are transmitted through apparatus for testing a hydraulic signature 10 may be initially recorded over a given time interval. Assuming that all components of apparatus for testing a hydraulic signature 10 are properly functioning and that an associated apparatus that it couples with is properly in line, apparatus for testing hydraulic signature 10 can be used to record pressure values. Apparatus for testing a hydraulic signature 10 can be used to record both steady state pressures and dynamic pressure rates over time periods.

For example, if one desires to confirm that pressure is being maintained within the system or an associated apparatus, pressure may be ramped up to a desired pressure value in which hydraulic valve 30, relief valve 24, and relief valve 26 are closed. During this time period dual pressure recorder 18 may record such pressure values over a period of time. As pressure is increased within apparatus for testing a hydraulic signature 10 the increasing pressures may be recorded. Once a desired pressure is attained, pressure may cease being input and hydraulic valve 38 may be closed. For a specified period of time, pressure values should continue to be recorded via pressure recording device 18. Pressure should be maintained in the system for a period of time so that one can determine if all components are properly functioning. These components can include various seals, sealing mechanisms, and transmission mechanisms. Pressure recording device 18 may then transmit data to another location such as an onboard computer or a processor, or offsite data center. In alternative embodiments, pressure recording device 18 may transmit data to an integrated onboard processor which in turn sends data wirelessly or through data lines to another processor or data storage device. Assuming that all components are properly functioning, these values may be recorded as "good" values. Once "good" values have been attained, such tests can be repeated to ensure that apparatus for testing a hydraulic signature 10 and associated components are properly functioning. As various tests are performed using apparatus for testing a hydraulic signature 10, received pressure values can be recorded and compared to the initially obtained "good" values. In the event that subsequent pressure values do not result in substantially similar values to "good" values previously achieved, one may be alerted that an associated component may be near failure. An example, which is illustrative of such behavior, occurs when hydraulic valves are not fully sealing, perhaps due to additives jammed in their path. Another example which can allow for pressure lossage is pipe joints which can wear down due to excessive coupling or over torque.

Additionally, apparatus for testing hydraulic signature 10 can dynamically compare hydraulic signatures. Hydraulic valve 30 may be opened to release pressure which will eventually reach an associated component. Pressure can reach an associated component most often via hydraulic valve 30, vent 24, vent 26, or any additional pressure releasing mechanism associated with apparatus for testing hydraulic signature 10. As pressure is disposed within apparatus for testing hydraulic signature 10 and measurements are taken over time, via pressure recording device 18 a hydraulic signature can be obtained. Assuming that all components are properly functioning, this hydraulic signature may be deemed a "good" hydraulic signature, without having to close any valves. Apparatus for testing hydraulic signature may continue to function over time while data is gathered via pressure recording device 18. As pressure is gathered over a period of time and various flow rates are implemented according to the desired task, each subsequent flow rate can be compared to the initially achieved "good" hydraulic signature and various trends can be observed. In the event that sufficient wear and tear has occurred on various components of apparatus for testing hydraulic signature 10 or an associated component, and the hydraulic signature begins to shift, the associated component or valves contained within and/or associated with apparatus for testing hydraulic signature 10 can be closed ahead of time in order to prevent failure.

In certain embodiments, predetermined hydraulic signatures can be loaded onto pressure recording device 18. Once apparatus for testing hydraulic signature 10 begins functioning, existing flows and pressures can be compared to predetermined values and functionality of both apparatus for testing hydraulic signature 10 and/or associated components can be determined. In the event that flows and pressures are not attaining predetermined hydraulic signature levels, pressure and flow can be increased or decreased as necessary. For example, lower flow rate data can be preloaded onto pressure recording device 18 prior to starting apparatus for testing hydraulic signature 10. Once apparatus for testing hydraulic signature 10 begins functioning any components that are improperly functioning would not ordinarily be picked up, but rather would be used to determine the initial hydraulic signature. Pre-stored data is beneficial because if a component of apparatus for testing hydraulic signature is not properly functioning at the onset, the failure can be immediately detected, the component repaired, and the machines functionality restored.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification, but only by the claims.

What is claimed is:

1. A subsea apparatus for testing a hydraulic signature comprising:

a fluid supply;

a first pressure line coupled to the fluid supply;

a second pressure line coupled to the fluid supply; and a pressure recording device operatively coupled to both the first pressure line and the second pressure line;

storage of pre-determined pressure data representative of said pressure lines in said pressure recording device;

wherein the first pressure line functions at a lower pressure than the second pressure line; and wherein said pressure recording device records data and compares actual pressure data on said lines with said stored data.

2. The apparatus for testing a hydraulic signature of claim 1, further comprising a gauging device coupled to the first pressure line.

3. The apparatus for testing a hydraulic signature of claim 1, further comprising a processor for comparing data recorded by said recording device.

4. The apparatus for testing a hydraulic signature of claim 1, further comprising a regulating mechanism operatively disposed between the fluid supply and the first pressure line coupled to the fluid supply.

5. The apparatus for testing a hydraulic signature of claim 1, further comprising a regulating mechanism operatively disposed between the fluid supply and the second pressure line coupled to the fluid supply.

6. The apparatus for testing a hydraulic signature of claim 1 further comprising a control for maintaining constant fluid flow regardless of pressure and temperature changes.

7. The apparatus for testing a hydraulic signature of claim 1, further comprising a communicating device for translating a pressure reading into an electric signature.

8. The apparatus for testing a hydraulic signature of claim 1, further comprising a pressure relief operatively coupled to the first pressure line.

9. The apparatus for testing a hydraulic signature of claim 1, further comprising a processor for comparing said stored data with said pressure data to determine potential failure of pressure lines.

10. The apparatus for testing a hydraulic signature of claim 1, further comprising a gauge saving valve operatively coupled to the first pressure line.

11. The apparatus for testing a hydraulic signature of claim 10, further comprising an isolation valve operatively associated with the gauge saving valve for isolating pressure between the gauge saving valve and the pressure recording device.

12. The apparatus for testing a hydraulic signature of claim 1, further comprising a valve operatively coupled to an apparatus for receiving pressure.

13. The apparatus of claim 12, wherein the apparatus for receiving pressure is a BOP.

* * * * *